US009451851B1

(12) United States Patent
Lukawski

(10) Patent No.: US 9,451,851 B1
(45) Date of Patent: Sep. 27, 2016

(54) TISSUE DISPENSER WITH TISSUE SUPPLY ADVANCING FEATURE

(71) Applicant: Metal Art, Inc., Geneva, IL (US)

(72) Inventor: Edward Z Lukawski, Geneva, IL (US)

( * ) Notice: Subject to any disclaimer, the term of this patent is extended or adjusted under 35 U.S.C. 154(b) by 163 days.

(21) Appl. No.: 14/458,364

(22) Filed: Aug. 13, 2014

Related U.S. Application Data

(60) Provisional application No. 61/990,224, filed on May 8, 2014.

(51) Int. Cl.
*B65H 1/08* (2006.01)
*A47K 10/42* (2006.01)

(52) U.S. Cl.
CPC ..... *A47K 10/422* (2013.01)

(58) Field of Classification Search
CPC ..... A47K 10/422
USPC ..... 221/56, 58, 48, 63, 52, 34, 62; 206/45.16, 494, 233, 761, 815
See application file for complete search history.

(56) References Cited

U.S. PATENT DOCUMENTS 772,381 A * 10/1904 Seegmiller ..... B65D 5/3621 229/117
2,287,420 A * 6/1942 Edmonston ..... B65D 83/0811 206/804
2,307,146 A * 1/1943 McCash ..... B65D 5/5213 206/761
2,598,050 A * 5/1952 Guyer ..... B65D 5/5007 206/494
2,634,855 A * 4/1953 Mandel ..... B65D 83/0817 221/59
2,636,599 A * 4/1953 Willis ..... B65D 5/72 221/48
2,849,152 A * 8/1958 Tuttle ..... A47K 10/422 221/48
3,178,054 A * 4/1965 Lindecker ..... B65D 83/0811 221/58
3,603,452 A * 9/1971 Singer ..... A47K 10/421 206/494
3,942,682 A * 3/1976 McKay ..... B65D 83/0817 206/494
4,616,767 A * 10/1986 Seido ..... A47K 10/421 221/58
5,197,631 A * 3/1993 Mishima ..... A47K 10/422 221/279
6,283,295 B1 * 9/2001 Akutagawa ..... A47K 10/422 206/233
7,360,667 B2 * 4/2008 Stravitz ..... A47K 10/421 221/34
2006/0060599 A1 * 3/2006 Zychinski ..... A47K 10/422 221/52

FOREIGN PATENT DOCUMENTS

AU WO 0153169 A1 * 7/2001 ..... A47K 10/422

* cited by examiner

*Primary Examiner* — Rakesh Kumar
(74) *Attorney, Agent, or Firm* — Thomas Paulius; Law Offices of Konrad Sherinian

(57) ABSTRACT

A tissue dispenser with a tissue advancement features includes a multi-sided dispenser with a hollow interior. Tissues are supported upon an advancement plate within the interior. A dispensing opening is disposed in a top of the dispenser and the advancement plate lies on the bottom of the interior. The bottom of the dispenser includes two advancement flaps, or legs that are frangible formed with the dispenser bottom by way of perforated lines. The perforated lines are broken by a user and the advancement flaps rotated into the interior and into contact with the bottom of the advancement plate. Further pushing of the flaps engages them with tabs on the advancement plate to hold it in place within the dispenser at a level nearer the dispenser opening.

18 Claims, 5 Drawing Sheets

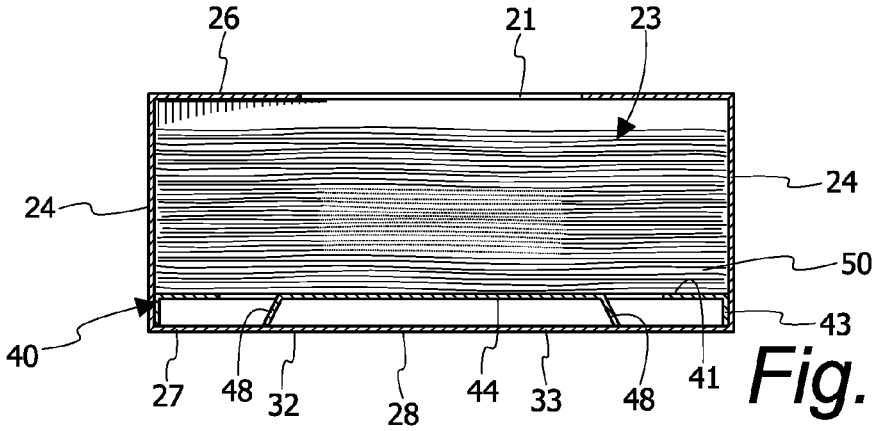
Fig. 5
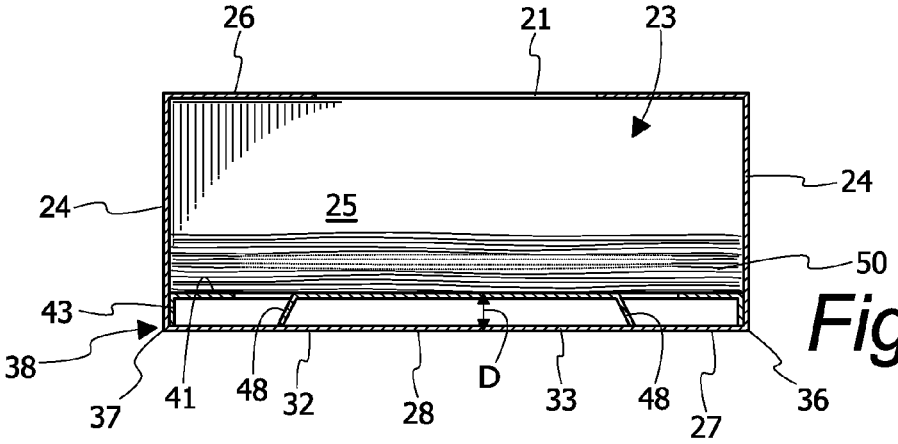
Fig. 6
Fig. 7
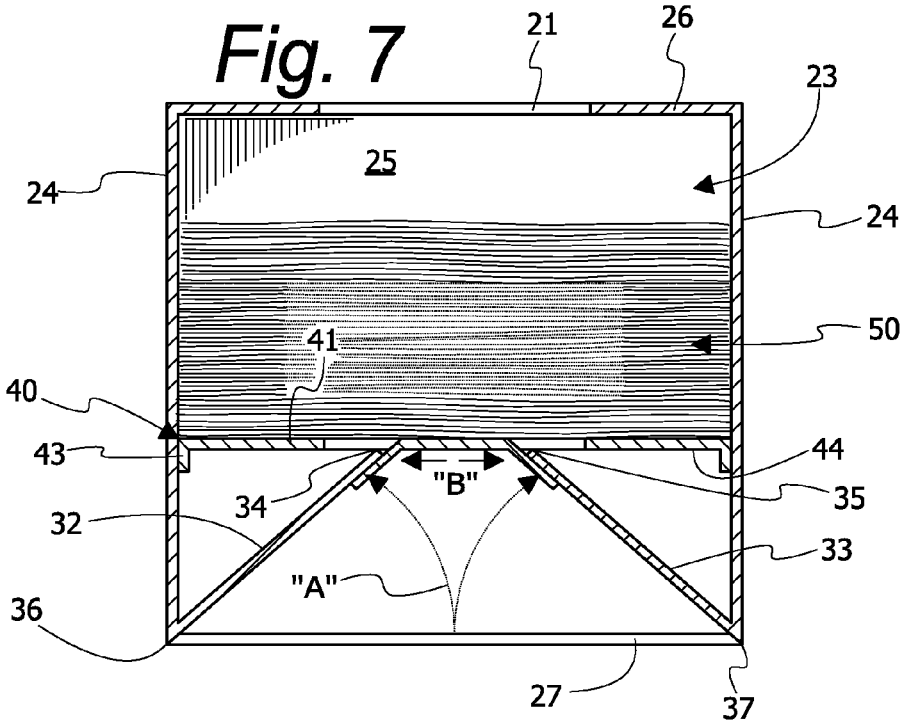

TISSUE DISPENSER WITH TISSUE SUPPLY ADVANCING FEATURE

REFERENCE TO RELATED APPLICATIONS

This is a non-provisional patent application which claims priority under 35 U.S.C. 119(e) of prior provisional application No. 61/990,224, filed May 8, 2014 and entitled "Tissue Advancing Feature for Tissue Dispensers, the disclosure of which is hereby incorporated by reference.

BACKGROUND OF THE DISCLOSURE

The present disclosure relates generally to tissue dispensers, and more particularly, to an improved tissue dispenser which includes an integrated structure for advancing the tissues contained in the dispenser.

Paper tissues are used everyday by people. The tissues are typically sold in a box that contains a supply of tissues that are transferred by the user to a dispenser. Or, the tissue box itself is a tissue dispenser. In such situations, the dispenser will have a perforated opening along one surface that the consumer removes. The leading tissue is grasped and pulled out of the dispenser. The tissues are typically interleaved so that a subsequent tissue is pulled partially out of the dispenser opening. This process works well enough when the tissue dispenser is full, or about half full, but around the half full mark, and especially lower, the tissues become harder to grasp by a user. This can occur if the subsequent tissues do not follow, or cling to a protruding tissue and the subsequent tissue are not exposed a sufficient height out of the dispenser opening, or not at all.

When this happens, the subsequent tissues often fall back within the dispenser box. A user must then reach into the dispenser opening and try to grasp the top tissue sitting in the dispenser. This is difficult and becomes frustrating to the user of the dispenser and the difficulty of grasping tissues increases as the supply of tissues dwindles in the dispenser. When the supply of tissues dwindles, the user is more likely when grasping a tissue, to pull out multiple tissues, thereby wasting a portion of the supply in the dispenser. Reaching deep into the dispenser takes more time than if the tissue were partially extending out of the tissue dispenser opening. A need therefore exists for a tissue dispenser that has a structure that advances the tissue supply toward the dispenser opening as the tissue supply is drawn down by a user.

The present disclosure is therefore directed to an improved tissue dispenser that is provided with a structure to advance the tissues in the dispenser to a position nearer the dispenser opening when the supply of tissues begins to draw down in the dispenser.

SUMMARY OF THE PRESENT DISCLOSURE

Accordingly, there is provided an improved tissue dispenser with an advancement feature that is integrated into the structure of the dispenser and which provides the beneficial feature of advancing a stack of tissue toward the dispenser opening.

In accordance with an embodiment as described in the following disclosure, a tissue dispenser is provided in the form of a box with four side walls and opposing top and bottom walls. The side, top and bottom walls all collectively define a hollow interior in which a supply of tissues is inserted during the assembly process. An opening is formed in the top wall of the dispenser through which a uses grasps and removes tissues in serial order from the supply of tissues enclosed in the dispenser. This structure will suffice until the dispenser is about half full.

The bottom wall of the dispenser is scored with a series of perforated lines. The perforated lines are preferably arranged in an H-shaped pattern with the legs of the "H" extending transversely to a longitudinal axis of the dispenser, aligned with and underneath the dispenser opening. The perforations may be broken by the user when the tissue supply is drawn down to about half the original supply and when broken, two flap portions are defined. The flap portions remain connected to the dispenser along the sidewalls thereof. These connections serve as points about which the flaps may be rotated or pivoted inwardly by the user.

A advancement, or support, tray is provided within the dispenser that supports the supply of tissues in an orderly stack. The tray includes at least two engagement tabs that extend downwardly and preferably at an acute angle to the plane of the tray. The user may rotate the flaps inside of the dispenser where they will come into contact and ride upon the bottom surface of the tray. With this movement, the flaps will push the tray upwardly in the dispenser. Continued pivoting movement of the flaps translates into linear movement by the end edges of the flaps in a transverse, or sideways, fashion which raises the tray an additional amount.

The user continues to pivot the flaps inwardly until they ride over the ends of the tabs of the interior advancement tray. The downward extent of the tabs of the advancement tray serve as stops, or catches, for the advancement flaps as they will arrest any movement of the flaps by engaging them and preventing them from any movement back toward the longitudinal axis of the tray. The flaps will hold the advancement tray at the designated level, or elevation, of about half in the tissue dispenser.

These and other objects, features and advantages of the present disclosure will be clearly understood through a consideration of the following detailed description.

BRIEF DESCRIPTION OF THE DRAWINGS

The organization and manner of the structure and operation of the disclosure, together with further objects and advantages thereof, may best be understood by reference to the following detailed description, taken in connection with the accompanying Figures, wherein like reference numerals identify like elements, and in which:

FIG. 5 is a sectional view taken through the tissue dispenser of FIG. 1 along lines 4-4 thereof;

FIG. 6 is the same view as FIG. 4, but with the tissue supply of the dispenser drawn down to about half full;

FIG. 7 is the same view as FIG. 6, but with the tissue dispenser bottom wall flaps broken along their perforations and pivoted inwardly into engagement with the bottom surface of the tissue tray;

DETAILED DESCRIPTION OF THE DISCLOSURE

While the present disclosure may be susceptible to embodiment in different forms, there is shown in the Figures, and will be described herein in detail, specific embodiments, with the understanding that the disclosure is to be considered an exemplification of the principles of the present disclosure, and is not intended to limit the present disclosure to that as illustrated.

In the illustrated embodiments, directional representations—i.e., up, down, left, right, front, rear and the like, used for explaining the structure and movement of the various elements of the present disclosure, are relative. These representations are appropriate when the elements are in the position shown in the Figures. If the description of the position of the elements changes, however, it is assumed that these representations are to be changed accordingly.

Figure 1:
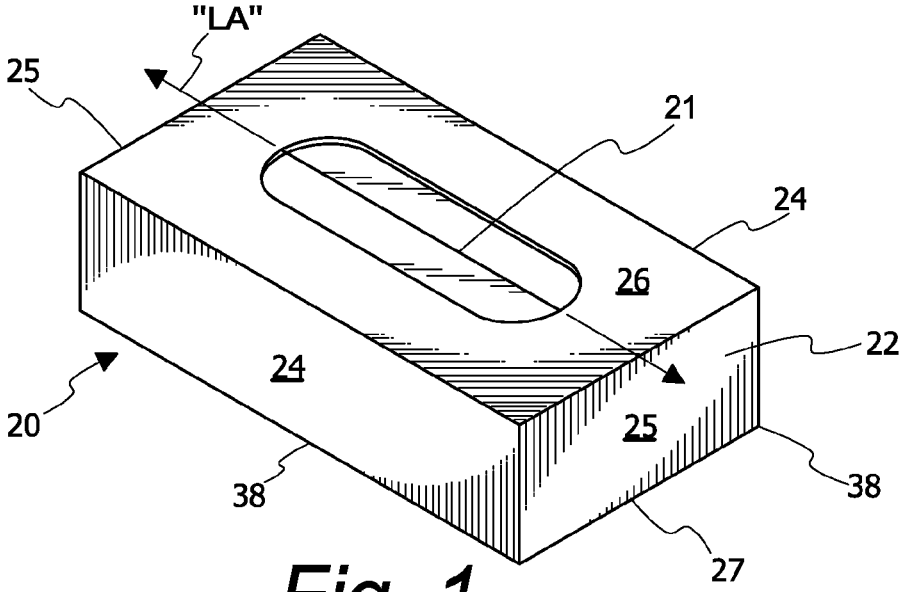
FIG. 1 illustrates a tissue dispenser constructed in accordance with the principles of the present disclosure.

FIG. 1 is a perspective view of a tissue dispenser 20 constructed in accordance with the principles of the present disclosure. The dispenser 20 takes the form of a rectangular box 22 with side walls 24, end walls 25, top wall 26 and bottom wall 27. All these walls 24-27 are interconnected together to form an enclosure with a hollow interior 23. The dispenser may be formed from a single blank of durable cardboard or other suitable material which can be stamped and formed in its final configuration. The top wall 26 is preferably provided with an opening that extends longitudinally along a longitudinal axis LA of the tissue dispenser 20.

Figure 2:
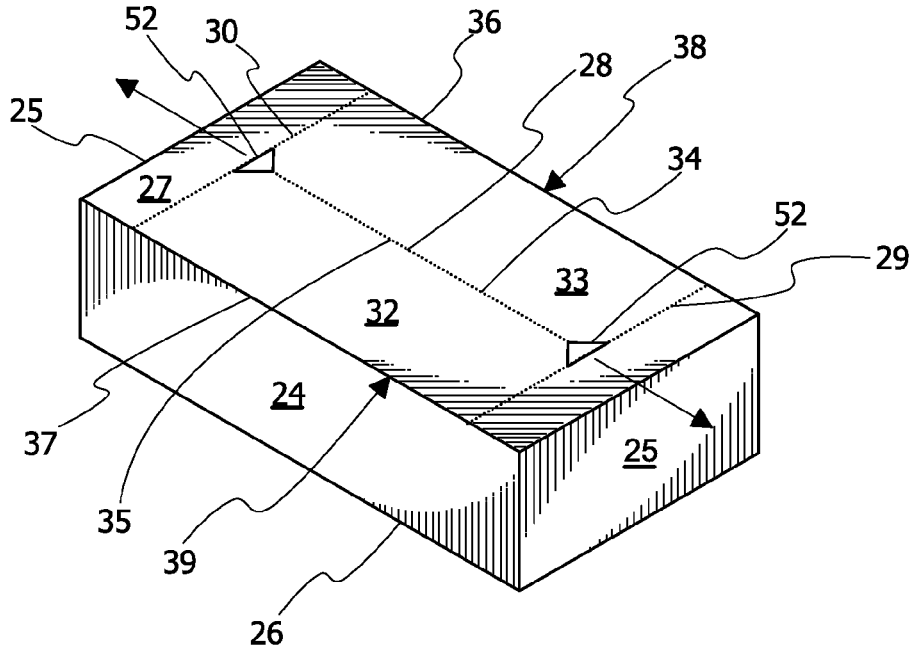
FIG. 2 is a perspective view of the underside of the tissue dispenser of FIG. 1, illustrating the perforations of the bottom wall which define the support legs of the tissue dispenser.

FIG. 2 illustrates the bottom of the dispenser 20. The bottom wall 27 includes a pair of advancement flaps 32, 33. These flaps 32, 33 have outer edges 36, 37 that are solidly connected to the dispenser sidewalls 24 along the bottom side (longitudinal edges) 38 of the dispenser 20. The remaining portion of the advancement flaps 32, 33 are frangibly attached to the box 22. A user breaks the frangible connections to free the advancement flaps 32, 33 from the bottom wall 27 and the flaps 32, 33 are pressed in by a user to raise the level of tissues in the dispenser 20 so that the tissue stack 50 is closer to the dispenser opening 21. The dispenser bottom wall 27 is scored with a plurality of perforated lines 28-30. One of the perforated lines 28 preferably extends longitudinally along axis LA or is slightly offset therefrom. The two remaining perforated lines, 29 & 30 extend transversely along the bottom wall 27 (from sidewall to sidewall) and join with the one perforated 28. The perforated lines 28-30 cooperatively define a continuous general "H" shape with the transverse lines 29 & 30 defining the legs of the H shape and the one line 28 defining the width of the H shape. As illustrated in FIG. 2.

The perforated lines 28-30 further define two advancement members that are shown in the Figures in the form of flaps 32, 33 which are integrally attached to the sidewalls 24 along their outermost edges 36, 37 as noted above and by which a user moves to raise the tissue stack within the dispenser. A user breaks the attachment flaps 32, 33 by pressing on the perforated lines 28-30 to separate the advancement flaps 32, 33 from engagement with each other and free them from the bottom wall 27. These flaps 32, 33 have free ends 34, 35 which are joined together along the length of the one perforated line 28 until such time as the perforated lines are broken by a user. Inasmuch as the outer edges 36, 37 of the advancement flaps 32, 33 are solidly attached to the dispenser 20, the advancement flaps are free to rotate respectively about the bottom side edges 38 of the dispenser 20.

Figure 3:
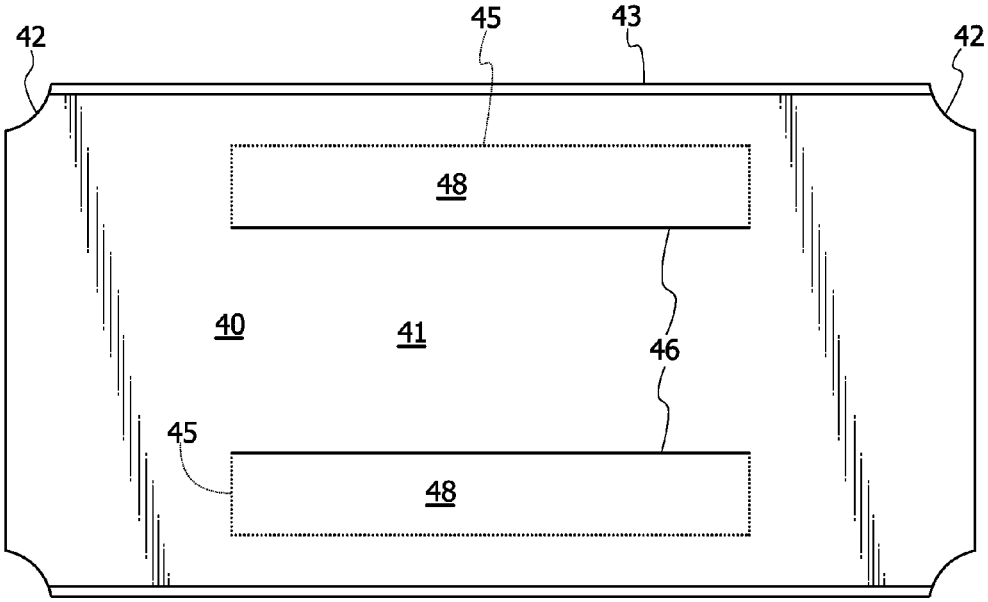
FIG. 3 is a top plan view of a blank that is used to form the support tray that is disposed with the tissue dispenser and which support a stack of tissues thereon.
Figure 4:
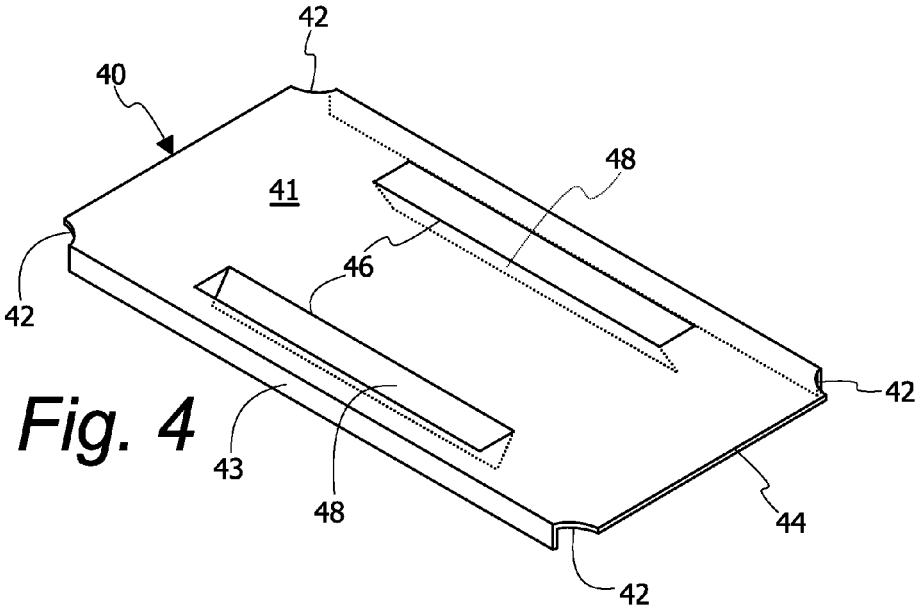
FIG. 4 is a perspective view of a support tray showing the locking tabs thereof bent downwardly.

FIGS. 3 and 4 illustrate a tissue support tray 40 that is disposed within the dispenser 20 which assists the advancement flaps 32, 33 in providing the tissue elevating advantages of the dispensers 20 of the present disclosure. As illustrated, the advancement tray 40 is generally planar and rectangular in shape. Its corners may be rounded with inward notches, or cutouts, 42 in order to reduce the likelihood of corners of the tray 40 from catching on the interior corners 43 of the dispenser 20 in its vertical movement within the dispenser interior 23. Likewise, the longitudinal side edges 43 of the tray 40 may be bent downwardly as shown in FIG. 4, to define soft, or somewhat rounded edges that face upwardly to facilitate the vertical movement of the tray 40 in the dispenser interior 23.

Figure 8:
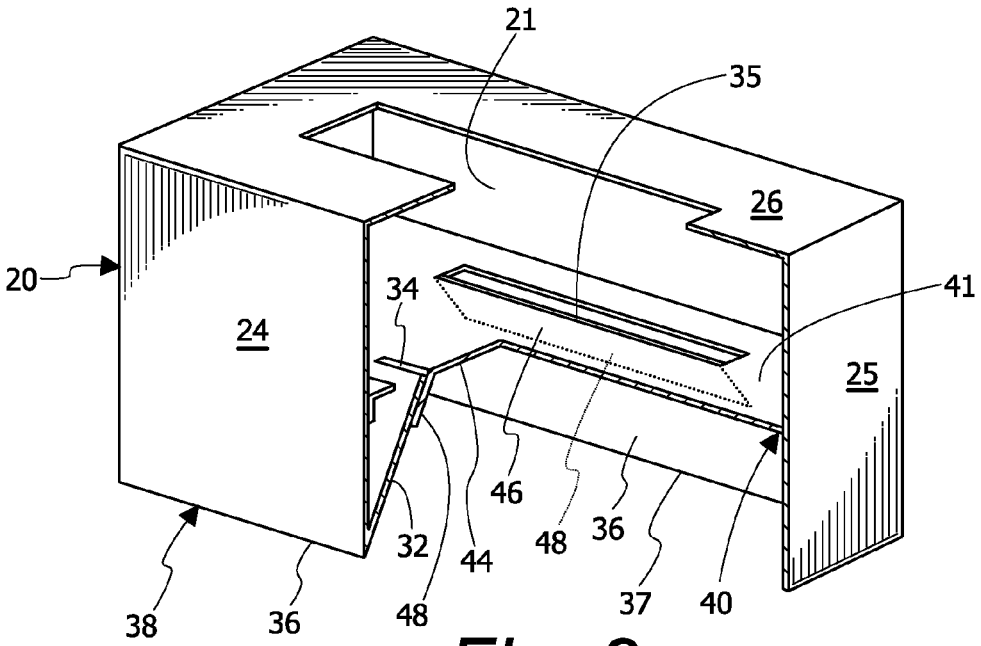
FIG. 8 is a partial sectional view of the tissue dispenser of FIG. 7, illustrating the bottom flaps engaged with the tabs of the tissue support tray.
Figure 9:
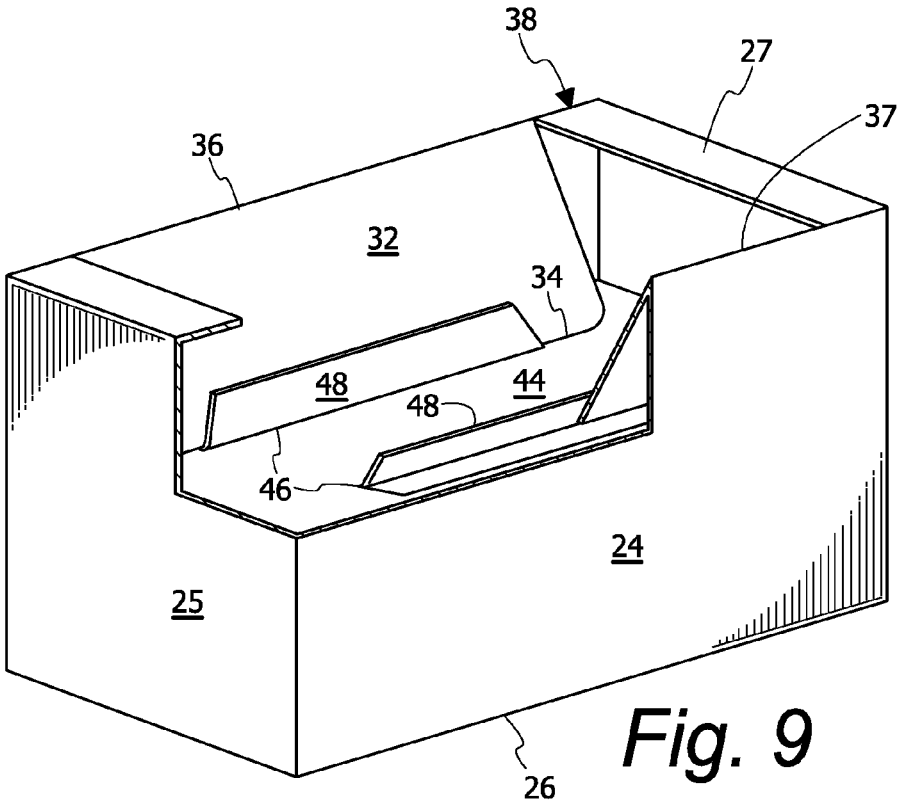
FIG. 9 is the same sectional view as FIG. 8, but with the tissue dispenser inverted so that the bottom wall is visible; and, FIG. 10 is a perspective view, partly in section, of another embodiment of a smaller and square tissue dispenser constructed in accordance with the principles of the present disclosure.

Additional perforated lines 45 that are arranged in the tray 40 in a general U-shape as illustrated in FIG. 3, are coupled with a pair of foldlines 46 to define two engagement tabs 48. The engagement tabs 48 are bent downwardly, preferably at an acute angle to the horizontal plane of the tray 40 and extending outwardly, as best illustrated in FIGS. 6-8 in order to maintain a first preselected elevation of the advancement tray within the dispenser interior. The depth D of the engagement tabs 48 is somewhat small so that the advancement tray at rest as shown in FIGS. 5 & 6, does not displace a large volume within the dispenser 20 and waste space for tissue storage. The depth is also enough to provide a sufficiently strong engagement edge that will engage the advancement flaps 32, 33 as described in detail to follow, without buckling.

As shown in FIG. 5, the tissues are supported in a stack 50, or other form of supply in the dispenser interior 23 on the advancement tray 40, and particularly on the top support surface 41 of the tray 40. As the tissues are used, the tissue stack 50 is drawn down to a level approximating that illustrated in FIG. 6 (which is about half the depth of the hollow interior 23) and the free space within the dispenser interior 23 increases to a point where it is difficult for a user to easily draw tissues from the tissue stack 50. This may be caused by a loss of friction between adjacent tissues as they are pulled through the free space out of the dispenser opening 21, such that a tissue does not pull a leader portion of a subsequent tissue out of the dispenser from the remaining stack 50 of tissues. Or, the tissues may fall out of interleaved contact due to the depth between the top wall and the top of the stack of tissues.

In accordance with the present disclosure, the perforated lines 28-30 are broken on the bottom wall of the dispenser to form the advancement flaps 32, 33. Due to their manner of attachment to the dispenser 20, the flaps are capable of rotational, or pivoting, movement around bottom side edges 38 that join them to the dispenser sidewalls 24. As shown in FIG. 7, one of the advancement flaps 33 pivots in a clockwise direction and the other flap 32 pivots in an opposite, counter-clockwise direction. The advancement flaps 32, 33 are pressed inwardly by the user and they pivot a small amount until they contact the bottom engagement surface of the tray 40. The user continues to press them and the pivotal motion of the flaps 32, 33 translates into linear motion by the advancement flap free ends 34, 35 along the bottom surface 44 of the advancement tray 40. During these movements, the advancement flaps 32, 33 push the advancement tray 40 up into the interior 23 of the dispenser 20.

The advancement flap free ends 34, 35 continue to ride on the bottom engagement surface of the tray 40 so that the tray 40 rises within the dispenser interior 23 until the flap free ends 34, 35 meet the tray engagement tabs 48. The advancement flaps 32, 33 are pushed further inwardly and the free ends 34, 35 thereof ride over the engagement tabs 48 and come to rest outside of the engagement tabs 48. The advancement flaps 32, 33 are locked in place by the engagement tabs 48 which prevent the flaps from moving inwardly and also counter-rotating out of the dispenser interior 23 under the weight of the tissue stack 50. It is preferred that the dispenser bottom wall 27 is bisected by the one perforated line 28, which may also lie along axis LA of the dispenser bottom wall 27 so that the advancement flaps 32, 22 are the same length so as not to tilt the tray 40 in the dispenser and thereby cause difficulty when raising the tray in the dispenser 20. It will be understood that the one perforated line 28 and LA need not be coincident and that some differences in the widths of the flaps 32, 33 may occur that will not adversely affect the vertical movement of the tray 40 in the dispenser interior 23. The depending side edges 43 of the tray 40 may also serve as end stops to the rotational movement of the advancement flaps. It is preferred that width W of the advancement flaps be about one-half the height H of the dispenser interior to elevate the tray to a level that facilitates the user grasping tissues through the dispenser opening from the tissue supply 50. Other dimensions may be chosen to accommodate different widths and heights of various sized dispensers.

Figure 10:
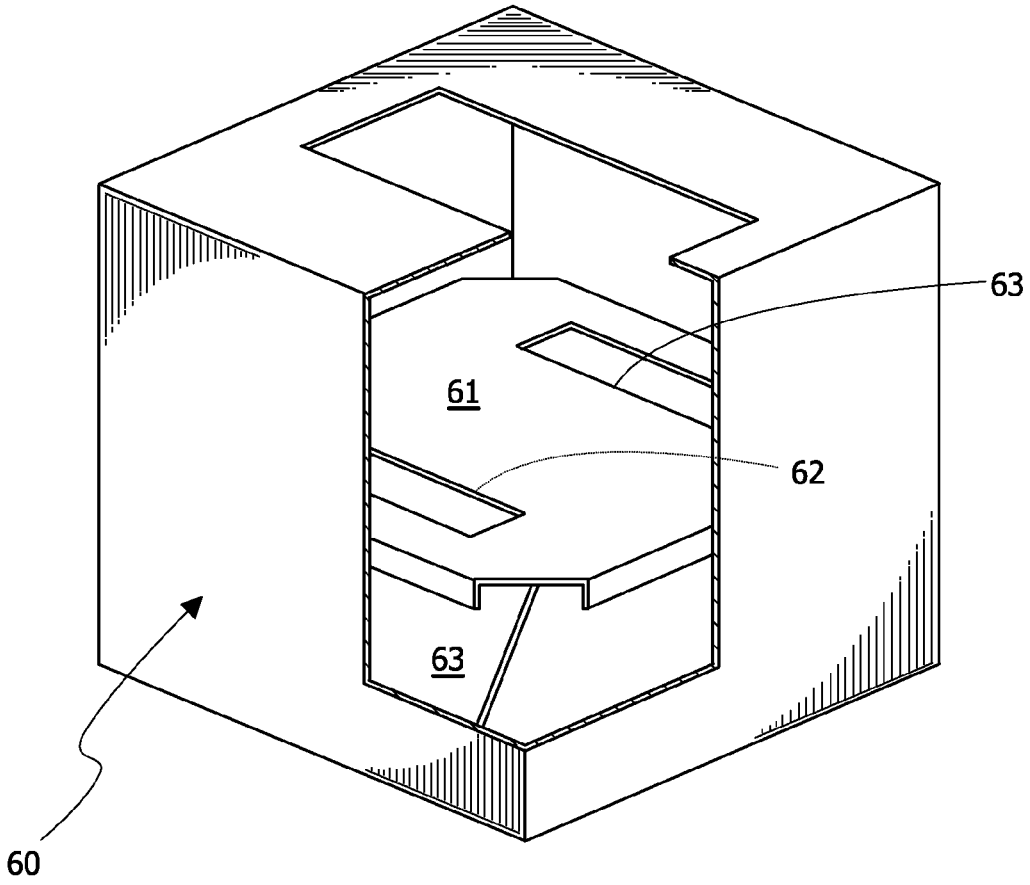

Notches 52 may be provided in the bottom wall 27 of the dispenser 20. As shown best in FIG. 2, these notches 52 are disposed at locations where the three perforated lines 28-30 are joined together and they facilitate breaking of the perforated lines by a user. Although the previous description has been applied to a dispenser in which the enclosure has a rectangular configuration, the principles of the present disclosure may also be applied to other configurations, such as the square enclosure 60 illustrated in FIG. 10. In such an embodiment, the tissue advancement tray 61 has a square configuration and the length of the longitudinal perforated line and the advancement flaps 63 are less than for a rectangular dispenser. The length of the engagement tabs 62 is also less, but otherwise the principles of operation remain the same.

While preferred embodiments have been shown and described, it is envisioned that those skilled in the art may devise various modifications without departing from the spirit and scope of the foregoing Description and the appended Claims.

What is claimed is:

1. A tissue dispenser, comprising:

an enclosure formed from a plurality of walls that cooperatively define a hollow interior;

a tissue advancement member disposed in the enclosure interior, the tissue advancement member having a generally planar tissue support surface and a pair of engagement tabs defining stops extending toward a bottom wall of the enclosure;

a plurality of tissues disposed in said enclosure interior and supported on said advancement member support surface; and, a pair of advancement flaps formed as part of the enclosure bottom wall, the advancement flaps being frangibly attached to each other along common ends and solidly attached to said enclosure along outer ends such that a user may press said advancement flaps to separate them from each other and move free ends of said advancement flaps into contact with the engagement tabs of said tissue advancement member to raise the plurality of tissues and support said tissue advancement member within said enclosure interior.

2. The tissue dispenser of claim 1, wherein said advancement flaps are frangibly attached to each other by way of perforated lines formed in said enclosure bottom wall, the perforated lines being joined together.

3. The tissue dispenser of claim 2, wherein said enclosure bottom wall further includes notches disposed at the intersections of said perforated lines, the notches facilitating breaking of the perforated lines by a user.

4. The tissue dispenser of claim 2, wherein, after said perforated lines are broken, one of said advancement flaps rotates in a first direction into said enclosure interior and the other of said advancement flaps rotates inwardly in a second direction, opposite to the first direction, into said enclosure interior.

5. The tissue dispenser of claim 4, further including notches disposed at junctions of said perforated lines, the notches facilitating breaking of said perforated lines by a user.

6. The tissue dispenser of claim 4, wherein the one direction is a clockwise direction and the other direction is a counter-clockwise direction.

7. The tissue dispenser of claim 4, wherein when said advancement flaps are pressed inwardly into said hollow interior, said advancement flaps raise said tissue advancement member in said enclosure interior.

8. The tissue dispenser of claim 1, wherein said advancement flaps are formed as part of said enclosure bottom wall and defined therein by a plurality of perforated lines, formed in said enclosure bottom wall, one of the perforated lines extending lengthwise in said enclosure bottom wall and two of said perforated lines extending transversely in said enclosure bottom wall and transversely to the one perforated line.

9. The tissue dispenser of claim 8, wherein said advancement flaps are rotated into contact with said tissue advancement member to raise said tissue advancement member within said enclosure interior, said engagement tabs retaining said advancement flaps in contact with said tissue advancement member.

10. The tissue dispenser of claim 8, wherein said one perforated line is arranged at approximately a centerline of said enclosure bottom wall.

11. The tissue dispenser of claim 1, wherein said dispenser is made from a cardboard.

12. A tissue dispenser, comprising:

an enclosure, the enclosure including a plurality of interconnected walls that cooperatively define a hollow interior, the walls including at least opposing top and bottom walls;

a tissue advancement member having a support surface for supporting a supply of tissues, the tissue advancement member being disposed in the hollow interior such that the support surface thereof opposes an opening of the enclosure top wall, said tissue advancement member including a pair of stops formed therein and extending away from said enclosure top wall, said tissue advancement stops including elongated tabs extending lengthwise along a bottom of said tissue advancement member and further extending downwardly at an acute angle therefrom;

a supply of tissues supported on said tissue advancement member support surface; and, a plurality of perforated lines formed in the enclosure bottom wall, the perforated lines being joined together to define pair of advancement flaps, whereby, when a user breaks the perforated lines, the advancement flaps separate from each other and are moved into contact with said tissue advancement member to raise the elevation thereof within said hollow interior and move said tissue supply toward the enclosure top wall opening.

13. The tissue dispenser of claim 12, wherein said tissue advancement member further includes side edges depending downwardly therefrom and away from said enclosure top wall.

14. The tissue dispenser of claim 12, wherein said elongated tabs engage free ends of said advancement flaps to support said tissue advancement member at a preselected elevation within said hollow interior.

15. The tissue dispenser of claim 12, wherein said perforated lines are joined together, and one of said perforated lines extends lengthwise in said enclosure bottom wall and the remaining perforated lines are offset from the one perforated line.

16. The tissue dispenser of claim 14, wherein the free ends of said advancement flaps confront each other and outer ends of said advancement flaps are joined to sidewalls of said enclosure, to thereby permit said advancement flaps to respectively rotate about opposite bottom edges of said enclosure.

17. The tissue dispenser of claim 16, wherein said tissue advancement member includes a tray configured to fit within said hollow interior, the tray including cutouts disposed at corners thereof to eliminate said tray from catching on said dispenser during movement thereof.

18. A tissue dispenser, comprising:

an enclosure, the enclosure including a plurality of interconnected walls that cooperatively define a hollow interior, the walls including at least opposing top and bottom walls;

a tissue advancement member having a support surface for supporting a supply of tissues, the tissue advancement member being disposed in the hollow interior such that the support surface thereof opposes an opening of the enclosure top wall, said tissue advancement member including a pair of stops formed therein and extending away from said enclosure top wall;

a supply of tissues supported on said tissue advancement member support surface;

a plurality of perforated lines formed in the enclosure bottom wall, one of said perforated lines extending lengthwise in said enclosure bottom wall and two other perforated lines transversely from the one perforated line, and said perforated lines being joined together to define pair of advancement flaps, having outer edges that are joined to sidewalls of said enclosure, whereby, when a user breaks the perforated lines, the advancement flaps separate from each other and respectively rotate about opposite bottom edges of said enclosure to move into contact with said tissue advancement member to thereby raise the elevation thereof within said hollow interior and move said tissue supply toward the enclosure top wall opening.

* * * * *